United States Patent [19]

Im et al.

[11] Patent Number: 4,667,817

[45] Date of Patent: May 26, 1987

[54] SHOE CASE

[76] Inventors: Byung-Do Im, 1163 Yonkers Ave., Yonkers, N.Y. 10704; George Spector, 233 Broadway, Rm. 3615, New York, N.Y. 10007

[21] Appl. No.: 857,371

[22] Filed: Apr. 30, 1986

[51] Int. Cl.[4] ..... B65D 81/26; F17C 11/00

[52] U.S. Cl. ..... 206/204; 206/213.1; 12/128 B

[58] Field of Search ..... 206/204, 213, 213.1, 206/205, 278; 12/128 B

[56] References Cited

U.S. PATENT DOCUMENTS

| | | | |
|---|---|---|---|
| 1,912,694 | 6/1933 | Donovan | 206/213 |
| 2,541,525 | 2/1951 | Lewyt | 206/213.1 |
| 2,994,404 | 8/1961 | Schifferly | 206/204 |
| 3,087,679 | 4/1963 | Wilson | 206/213.1 |
| 3,096,148 | 7/1963 | Walker, Jr. | 206/213.1 |
| 3,918,578 | 11/1975 | Cullen et al. | 206/204 |
| 4,394,144 | 7/1983 | Aoki | 206/204 |

*Primary Examiner*—J. Moy

[57] ABSTRACT

A shoe case for storing a pair of shoes is provided and includes a built-in unit for dehumidifying the pair of shoes. The unit can also deodorize the pair of shoes.

8 Claims, 11 Drawing Figures

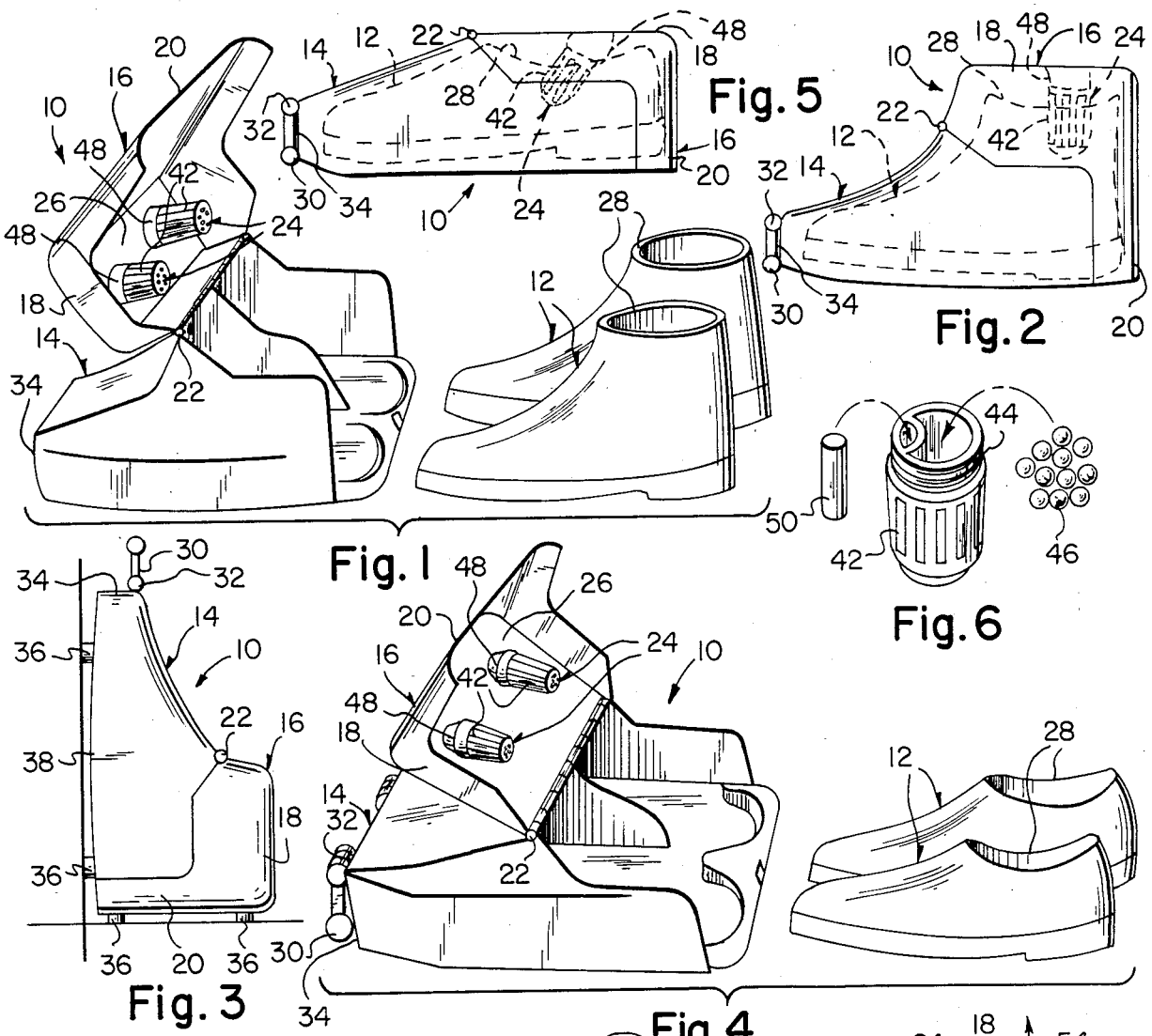
Fig. 1
Fig. 2
Fig. 3
Fig. 4
Fig. 5
Fig. 6
Battery Compartment
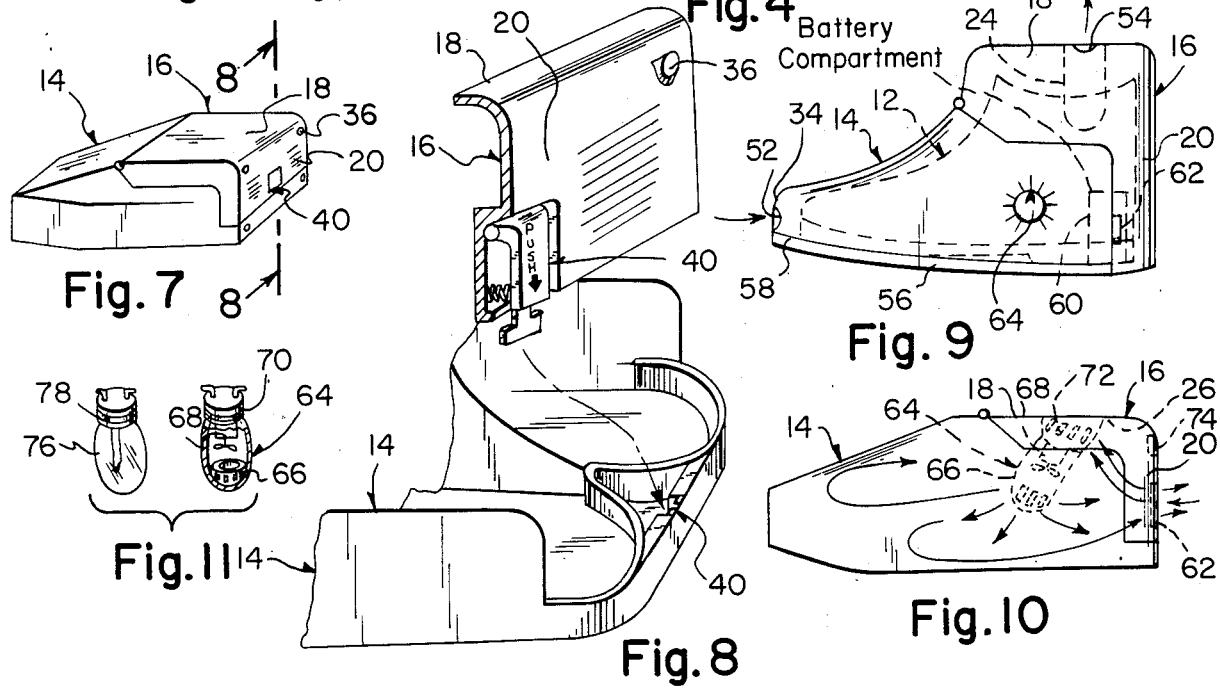
Fig. 7
Fig. 8
Fig. 9
Fig. 10
Fig. 11
PUSH

SHOE CASE

BACKGROUND OF THE INVENTION

The instant invention relates generally to containers for articles of apparel and more specifically it relates to a shoe case for storing, dehumidifying and deodorizing shoes and the like.

Numerous containers for articles of apparel have been provided in prior art that are adapted to hold the articles of apparel therein for storage purposes. For example, U.S. Pat. Nos. 2,342,406; 3,096,148 and 3,749,232 all are illustrative of such prior art. While these units may be suitable for the particular purpose to which they address, they would not be as suitable for the purposes of the present invention as heretofore described.

SUMMARY OF THE INVENTION

A primary object of the present invention is to provide a shoe case that will overcome the shortcomings of the prior art devices.

Another object is to provide a shoe case that will absorb humidity and eliminate odor from the pair of shoes stored within.

An additional object is to provide a shoe case in which the case can be stored vertically, horizontally or hung on a wall.

A further object is to provide a shoe case that is simple and easy to use.

A still further object is to provide a shoe case that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of a first form of the invention opened with boots ready to be inserted therein.

FIG. 2 is a side view of the first form closed with the boots inside.

FIG. 3 is a side view of the first form closed and stored in an upright position.

FIG. 4 is a perspective view of a second form of the invention opened with shoes ready to be inserted therein.

FIG. 5 is a side view of the second form closed with the shoes inside.

FIG. 6 is a perspective view of the capsule being recharged with anti-odor and anti-humid material.

FIG. 7 is a perspective view of a third form of the invention closed with a locking mechanism.

FIG. 8 is a partial exploded perspective view with cover in cross section as indicated by line 8—8 in FIG. 7 showing the locking mechanism therein in greater detail.

FIG. 9 is a side view of a fourth form of the invention closed having a built-in heating unit.

FIG. 10 is a side view of a fifth form of the invention closed with shoes inside having an electrical bulb or fan therein.

FIG. 11 is a perspective view of the bulb and the fan used in the fifth form.

DETAILED DESCRIPTION OF THE PREFERRED EMBODIMENTS

Turning now descriptively to the drawings, in which similar reference characters denote similar elements throughout the several views, FIGS. 1 through 5 illustrates a shoe case 10 for storing a pair of shoes 12 which consists of a housing 14 for receiving the pair of shoes 12 and an L-shaped cover 16 that has a first arm 18 and a second arm 20. The first arm 18 is hingeably mounted at 22 to to of the housing 14 above the pair of shoes 12.

A unit 24 is provided for dehumidifying the pair of shoes 12. The unit 24 is removably connected to underside 26 of the first arm 18 of the L-shaped cover 16 so that when the cover is in a closed position, the unit 24 will extend within tops 28 of the pair of shoes 12.

A handle 30 is pivotally secured at 32 to one side 34 of the housing 14 opposite the second arm 20 of the L-shaped cover 16. The handle 30 is pivotable between an upstanding position and a folded down position.

A plurality of supporting tabs 36 as shown in FIG. 3 are on the bottom 38 of the housing 14 for supporting the shoe case 10 in a horizontal position. Supporting tabs 36 are also on the second arm 20 of the L-shaped cover 16 for supporting the shoe case 10 in a vertical position.

FIGS. 7 and 8 show a manually operable latch mechanism 40 secured to the second arm 20 of the L-shaped cover 16 and the housing 14 for retaining the L-shaped cover in the closed position.

The dehumidifying unit 24 includes a pair of perforated capsules 42 that has externally threaded necks 44 whereby anti-humid material 46 (see FIG. 6) is placed within the capsules 42. A pair of internally threaded recepticles 48 are attached to the underside 26 of the first arm 18 of the L-shaped cover 16. The threaded necks 44 of the capsules 42 are removably connected to the recepticles 48 so that the anti-humid material 46 can be replaced when needed. Anti-odor material 50 can also be placed within the capsules 42 for deodorizing the pair of shoes 12.

In FIG. 9 another type of dehumidifying unit is shown in which the housing 14 has an air inlet port 52 through one side 34 opposite the second arm 20 of the L-shaped cover 16. The first arm 18 of the L-shaped cover has an air outlet port 54 therethrough. A hot plate 56 is mounted to underside 58 of the housing 14 below the pair of shoes 12. A battery 60 is within the housing 14 for supplying electrical current through a circuit to the hot plate 56. A switch 62 is mounted to the housing so that when the L-shaped cover 16 is in the closed position the second arm 20 will activate the switch 62 to close the circuit for the hot plate 56. A timer 64 is mounted to the housing 14 to control the battery 60 at predetermined time intervals so that the hot plate 56 can be turned on and off when needed.

FIGS. 10 and 11 shows still another type of dehumidifying unit that includes the second arm 20 of the L-shaped cover 16 having an air inlet and outlet port 62 therethrough. A pair of fan units 64 are provided. Each of the fan units contains a perforated capsule 66 that has a built-in electric fan 68 and a neck 70. A pair of perforated sockets 72 are attached to the underside 26 of the first arm 18 of the L-shaped cover 16 and is electrically connected to a power source via female outlet 74 on the second arm 20. The necks 70 of the fan units 64 are removably connected to the sockets 72 so that the fan units can be replaced when needed. The fan units 64 can be substituted with a pair of light bulbs 76 having necks 78 whereby the necks of the light bulbs are also removably connected to the sockets 72 so that the light bulbs can be replaced when needed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shoe case for storing a pair of shoes which comprises:

(a) a housing with shoe shaped compartments for receiving said pair of shoes;

(b) an L-shaped cover having a first arm and a second arm, said first arm is hingeably mounted to top of said housing above said pair of shoes; and (c) means for dehumidifying said pair of shoes, mounted on the underside of said first arm of said L-shaped cover so that when said cover is in a closed position, said means will extend within the tops of said pair of shoes.

2. A shoe case as in claim 1, wherein said means is removeably mounted.

3. A shoe case as recited in claim 1, further comprising:

(a) a handle pivotally secured to one side of said housing opposite said second arm of said L-shaped cover, said handle pivotable between an upstanding position and a folded down position; and (b) a plurality of supporting tabs, some of said supporting tabs are on bottom of said housing for supporting said shoe case in a horizontal position, while rest of said supporting tabs are on said second arm of said L-shaped cover for supporting said shoe case in a vertical position.

4. A shoe case as recited in claim 1, further comprising a manually operabale latch mechanism secured to said second arm of said L-shaped cover and said housing for retaining said L-shaped cover in said closed position.

5. A shoe case as recited claim 1, wherein said dehumidifying means includes:

(a) a pair of perforated capsules having externally threaded necks;

(b) anti-humid material placed within said capsules; and (c) said means compising a pair of internally threaded recepticles attached to said underside of said first arm of said L-shaped cover whereby said threaded necks of said capsules are removeably connected to said recepticles so that said anti-humid material can be replaced when needed.

6. A shoe case as recinted in claim 1, wherein said dehumidifying means includes:

(a) said housing having an air inlet port through one side opposite said second arm of said L-shaped cover;

(b) said first arm of said L-shaped cover having an air outlet port therethrough;

(c) a hot plate mounted to underside of said housing below said pair of shoes;

(d) a battery within said housing for supplying electrical current through a circuit to said hot plate;

(e) a switch mounted to said housing so that when said L-shaped cover is in said closed position said second arm will activate said switch to close said circuit for said hot plate; and (f) a timer mounted to said housing to control said battery at predetermined time intervals so that said hot plate can be turned on and off when needed.

7. A shoe case as recited in claim 1, wherein said dehumidifying means includes:

(a) said second arm of said L-shaped cover having an air inlet and outlet port therethrough;

(b) a pair of fan units, each of said fan units being a perforated capsule having a built- in electric fan and a neck; and (c) a pair of pereforated sockets attached to said underside of said first arm of said L-shaped cover and electrically connected to a power source whereby said necks of said fan units are removeably connected to said sockets so that said fan units can be replaced when needed.

8. A shoe case as recited in claim 1, wherein said dehumidifying means includes:

(a) said second arm of said L-shaped cover having an air inlet and outlet port therethrough;

(b) a pair of light bulbs having necks; and (c) a pair of perforated sockets attached to said underside of said first arm of said L-shaped cover and electrically connected to power source wherby said necks of said light bulbs are removeably connected to said sockets so that said light bulbs can be replaced when needed.

* * * * *